US008938193B2

(12) United States Patent
Suzuki et al.

(10) Patent No.: US 8,938,193 B2
(45) Date of Patent: Jan. 20, 2015

(54) FUSER UNIT

(71) Applicants: Noboru Suzuki, Komaki (JP); Kei Ishida, Nagoya (JP); Takuji Matsuno, Ichinomiya (JP); Kaoru Suzuki, Ichinomiya (JP); Kotaro Haruta, Gifu (JP)

(72) Inventors: Noboru Suzuki, Komaki (JP); Kei Ishida, Nagoya (JP); Takuji Matsuno, Ichinomiya (JP); Kaoru Suzuki, Ichinomiya (JP); Kotaro Haruta, Gifu (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 135 days.

(21) Appl. No.: 13/625,043

(22) Filed: Sep. 24, 2012

(65) Prior Publication Data

US 2013/0136511 A1 May 30, 2013

(30) Foreign Application Priority Data

Nov. 29, 2011 (JP) ..... 2011-260494
Nov. 29, 2011 (JP) ..... 2011-260508

(51) Int. Cl.
*G03G 15/20* (2006.01)

(52) U.S. Cl.
CPC ..... *G03G 15/2064* (2013.01); *G03G 15/2089* (2013.01)
USPC ..... 399/329

(58) Field of Classification Search
CPC ..... G03G 15/20
USPC ..... 399/329
See application file for complete search history.

(56) References Cited

U.S. PATENT DOCUMENTS

| | | | | |
|---|---|---|---|---|
| 6,944,420 | B2 * | 9/2005 | Kanamori et al. | 399/329 |
| 7,792,476 | B2 * | 9/2010 | Seol et al. | 399/329 |
| 8,107,871 | B2 * | 1/2012 | Finn et al. | 399/334 |
| 8,412,083 | B2 * | 4/2013 | Fujiwara et al. | 399/329 |
| 8,412,084 | B2 * | 4/2013 | Ishida et al. | 399/329 |
| 8,452,218 | B2 * | 5/2013 | Fujiwara et al. | 399/329 |
| 8,472,835 | B2 * | 6/2013 | Suzuki et al. | 399/90 |
| 8,489,007 | B2 * | 7/2013 | Fujiwara et al. | 399/329 |
| 8,494,424 | B2 * | 7/2013 | Ishida et al. | 399/329 |
| 8,509,667 | B2 * | 8/2013 | Miyauchi | 399/329 |
| 8,515,325 | B2 * | 8/2013 | Miyauchi et al. | 399/329 |
| 8,660,445 | B2 * | 2/2014 | Ishida et al. | 399/33 |
| 8,676,102 | B2 * | 3/2014 | Hiramatsu | 399/329 |
| 2007/0065191 | A1 * | 3/2007 | Iwasaki et al. | 399/328 |
| 2009/0208264 | A1 * | 8/2009 | Fujiwara et al. | 399/329 |
| 2009/0257794 | A1 * | 10/2009 | Kaino et al. | 399/329 |

(Continued)

FOREIGN PATENT DOCUMENTS

| | | |
|---|---|---|
| JP | 2011-095534 A | 5/2011 |
| JP | 2011-113015 A | 6/2011 |

*Primary Examiner* — Clayton E Laballe
*Assistant Examiner* — Kevin Butler
(74) *Attorney, Agent, or Firm* — Banner & Witcoff, Ltd.

(57) ABSTRACT

A fuser unit includes: a cylindrical member; a heat generation member; a nip plate; a backup member that forms a nip portion; and a temperature detection member that detects a temperature of the nip plate. The nip plate has: a plate-shaped part that forms the nip portion; a lubricant restraint part that is formed on at least a part of a downstream side end of the plate-shaped part in a predetermined direction and that extends toward an inner side in a diametrical direction of the cylindrical member, and a detected part that extends from an end of the lubricant restraint part toward the predetermined direction. The detected part is formed to be shorter than the plate-shaped part in an axial direction of the cylindrical member, and both ends of the detected part in the axial direction are adjacent to a space.

22 Claims, 4 Drawing Sheets

(56) References Cited

U.S. PATENT DOCUMENTS

| | | | | |
|---|---|---|---|---|
| 2010/0278569 | A1* | 11/2010 | Finn et al. | 399/329 |
| 2011/0058862 | A1* | 3/2011 | Yamaguchi et al. | 399/329 |
| 2011/0150544 | A1* | 6/2011 | Ishida et al. | 399/328 |
| 2011/0158715 | A1* | 6/2011 | Suzuki et al. | 399/329 |
| 2011/0158716 | A1* | 6/2011 | Fujiwara et al. | 399/329 |
| 2011/0158717 | A1* | 6/2011 | Suzuki et al. | 399/329 |
| 2011/0158718 | A1* | 6/2011 | Fujiwara et al. | 399/329 |
| 2011/0158719 | A1* | 6/2011 | Miyauchi et al. | 399/329 |
| 2011/0164906 | A1* | 7/2011 | Ishida et al. | 399/329 |
| 2011/0170919 | A1* | 7/2011 | Fujiwara et al. | 399/331 |
| 2011/0170920 | A1* | 7/2011 | Fujiwara et al. | 399/331 |
| 2011/0206406 | A1* | 8/2011 | Suzuki et al. | 399/90 |
| 2011/0211881 | A1* | 9/2011 | Suzuki et al. | 399/329 |
| 2011/0211882 | A1* | 9/2011 | Suzuki et al. | 399/329 |
| 2011/0236088 | A1* | 9/2011 | Maruyama | 399/329 |
| 2011/0318074 | A1* | 12/2011 | Hiramatsu | 399/329 |
| 2012/0051809 | A1* | 3/2012 | Miyauchi | 399/329 |
| 2012/0163883 | A1* | 6/2012 | Tsukawaki | 399/329 |
| 2012/0163884 | A1* | 6/2012 | Kondo et al. | 399/329 |
| 2012/0163885 | A1* | 6/2012 | Ishida | 399/329 |
| 2012/0163886 | A1* | 6/2012 | Suzuki | 399/329 |
| 2012/0251138 | A1* | 10/2012 | Ishida et al. | 399/33 |
| 2012/0251207 | A1* | 10/2012 | Ishida et al. | 399/329 |
| 2012/0275830 | A1* | 11/2012 | Suzuki et al. | 399/329 |
| 2012/0275831 | A1* | 11/2012 | Ishida et al. | 399/329 |
| 2012/0275832 | A1* | 11/2012 | Suzuki | 399/329 |
| 2012/0275833 | A1* | 11/2012 | Ishida et al. | 399/329 |
| 2012/0308276 | A1* | 12/2012 | Miyauchi | 399/329 |
| 2013/0071155 | A1* | 3/2013 | Suzuki et al. | 399/329 |
| 2013/0071156 | A1* | 3/2013 | Suzuki et al. | 399/329 |
| 2013/0071157 | A1* | 3/2013 | Suzuki et al. | 399/329 |
| 2013/0071158 | A1* | 3/2013 | Suzuki | 399/329 |
| 2013/0071159 | A1* | 3/2013 | Suzuki et al. | 399/329 |
| 2013/0084111 | A1* | 4/2013 | Iwata | 399/329 |
| 2013/0136511 | A1* | 5/2013 | Suzuki et al. | 399/329 |
| 2013/0136512 | A1* | 5/2013 | Suzuki et al. | 399/329 |
| 2013/0136513 | A1* | 5/2013 | Suzuki et al. | 399/329 |
| 2013/0136514 | A1* | 5/2013 | Suzuki et al. | 399/329 |
| 2013/0195527 | A1* | 8/2013 | Suzuki et al. | 399/329 |
| 2013/0287459 | A1* | 10/2013 | Ishida et al. | 399/329 |
| 2013/0315640 | A1* | 11/2013 | Miyauchi | 399/336 |
| 2013/0322937 | A1* | 12/2013 | Suzuki et al. | 399/329 |
| 2013/0322938 | A1* | 12/2013 | Suzuki et al. | 399/329 |
| 2013/0322939 | A1* | 12/2013 | Ishida et al. | 399/329 |
| 2014/0086648 | A1* | 3/2014 | Maruyama et al. | 399/329 |
| 2014/0086649 | A1* | 3/2014 | Hazeyama et al. | 399/329 |

* cited by examiner

FUSER UNIT

CROSS-REFERENCE TO RELATED APPLICATION

This application claims priority from Japanese Patent Applications No. 2011-260494 filed on Nov. 29, 2011 and No. 2011-260508 filed on Nov. 29, 2011, the entire subject matter of which is incorporated herein by reference.

TECHNICAL FIELD

This disclosure relates to a fuser unit including a cylindrical member having flexibility, a nip plate slidingly contacting an inner periphery of the cylindrical member and a backup member that forms a nip portion by sandwiching the cylindrical member between the nip plate and the backup member.

BACKGROUND

As described in JP-A-2011-113015, in a fuser unit having a cylindrical member, a nip plate and a backup member, a downstream side end of the nip plate in a conveyance direction is slightly bent obliquely upward and then is bent to a downstream side in the conveyance direction and thus a downstream side portion of the nip plate in the conveyance direction is disposed at a position higher than a nip portion forming portion by one step. In this art, one portion of the downstream side portion of the nip plate in the conveyance direction is formed to protrude toward the downstream side in the conveyance direction more than the other portion, and a temperature sensor is provided to the protruding part.

Meanwhile, as described in JP-A-2011-95534, in a fuser unit having a cylindrical member, a nip plate and a backup member, the fuser unit includes a stay having a U-shaped section and supporting the nip plate from an opposite side to the backup member. Specifically, according to this art, both end faces of the stay facing the nip plate support a surface of the nip plate.

SUMMARY

According to JP-A-2011-113015, in a case where lubricant provided to an inner periphery of the cylindrical member flows to an upper surface of the other portion in the downstream side portion of the nip plate in the conveyance direction, since the other portion and the one portion are connected to be flush with each other, the lubricant flows along the other portion and reaches the one portion. In this case, the precision in temperature detection by the temperature sensor is to be deteriorated.

Accordingly, this disclosure provides at least a fuser unit capable of suppressing lubricant from flowing to a portion of a nip plate, in which a temperature thereof is detected by a temperature sensor (temperature detection member).

Meanwhile, according to JP-A-2011-95534, since the surface of the nip plate is supported at both end faces of the stay, an amount of heat to be transferred from the nip plate to the stay (specifically, a heat transfer area between a reflection plate, which is sandwiched between the nip plate and the stay, and the nip plate is increased), so that it is not possible to efficiently heat the nip plate.

Accordingly, this disclosure also provides at least a fuser unit capable of efficiently heating a nip plate.

A fuser unit of this disclosure heat-fixes a developer image on a recording sheet while moving the recording sheet in a predetermined direction. The fuser unit comprises: a cylindrical member; a heat generation member; a nip plate; a backup member; a lubricant; and a temperature detection member. The cylindrical member has flexibility. The heat generation member is arranged at an inside of the cylindrical member. The nip plate is arranged at the inside of the cylindrical member and radiation heat from the heat generation member is applied to the nip plate. The backup member forms a nip portion by sandwiching the cylindrical member between the nip plate and the backup member. The lubricant is provided to an inner periphery of the cylindrical member. The temperature detection member detects a temperature of the nip plate. The nip plate has a plate-shaped part that forms the nip portion; a lubricant restraint part that is formed on at least a part of a downstream side end of the plate-shaped part in the predetermined direction and that extends toward an inner side in a diametrical direction of the cylindrical member; and a detected part that extends from an end of the lubricant restraint part toward the predetermined direction, wherein a temperature of detected part is detected by the temperature detection member. The detected part is formed to be shorter than the plate-shaped part in an axial direction of the cylindrical member, and both ends of the detected part in the axial direction are adjacent to a space.

According to the above configuration, both axial ends of the detected part are adjacent to a space. Accordingly, compared to a configuration where both axial sides of the detected part are provided with a part flush with the detected part, it is possible to suppress the lubricant from flowing to the detected part along the one portion.

Meanwhile, a fuser unit of this disclosure heat-fixes a developer image on a recording sheet while moving the recording sheet in a predetermined direction. The fuser unit comprises: a cylindrical member; a heat generation member; a nip plate; a stay; and a backup member. The cylindrical member has flexibility. The heat generation member is arranged at an inside of the cylindrical member. The nip plate is arranged at the inside of the cylindrical member and radiation heat from the heat generation member is applied to the nip plate. The stay having a U-shaped section supports the nip plate while surrounding the heat generation member. The backup member forms a nip portion by sandwiching the cylindrical member between the nip plate and the backup member. An upstream side of the nip plate in the predetermined direction is formed with a bent part that is bent toward an upstream side wall of the stay, and end of the bent part is supported by the upstream side wall.

According to the above configuration, it is possible to reduce a heat transfer area between the nip plate and the stay (or a member arranged between the nip plate and the stay), compared to a configuration where a plain of the nip plate is supported by the stay. Accordingly, it is possible to reduce an amount of heat to be transferred from the nip plate to the stay, thereby efficiently heating the nip plate.

BRIEF DESCRIPTION OF THE DRAWINGS

The foregoing and additional features and characteristics of this disclosure will become more apparent from the following detailed descriptions considered with the reference to the accompanying drawings, wherein.

DETAILED DESCRIPTION

Hereinafter, illustrative embodiments of this disclosure will be specifically described with reference to the drawings. In the below descriptions, a schematic configuration of a laser printer 1 having a fuser unit 100 according to an illustrative embodiment of this disclosure will be briefly described and then a specific configuration of the fuser unit 100 will be described.

Also, in the below descriptions, the directions are described on the basis of a user who uses the laser printer 1. That is, the left side of FIG. 1 is referred to as the 'front', the right side is referred to as the 'rear', the back side is referred to as the 'left' and the front side is referred to as the 'right.' Also, the upper-lower direction of FIG. 1 is referred to as the 'upper-lower.'

<Schematic Configuration of Laser Printer>

Figure 1:
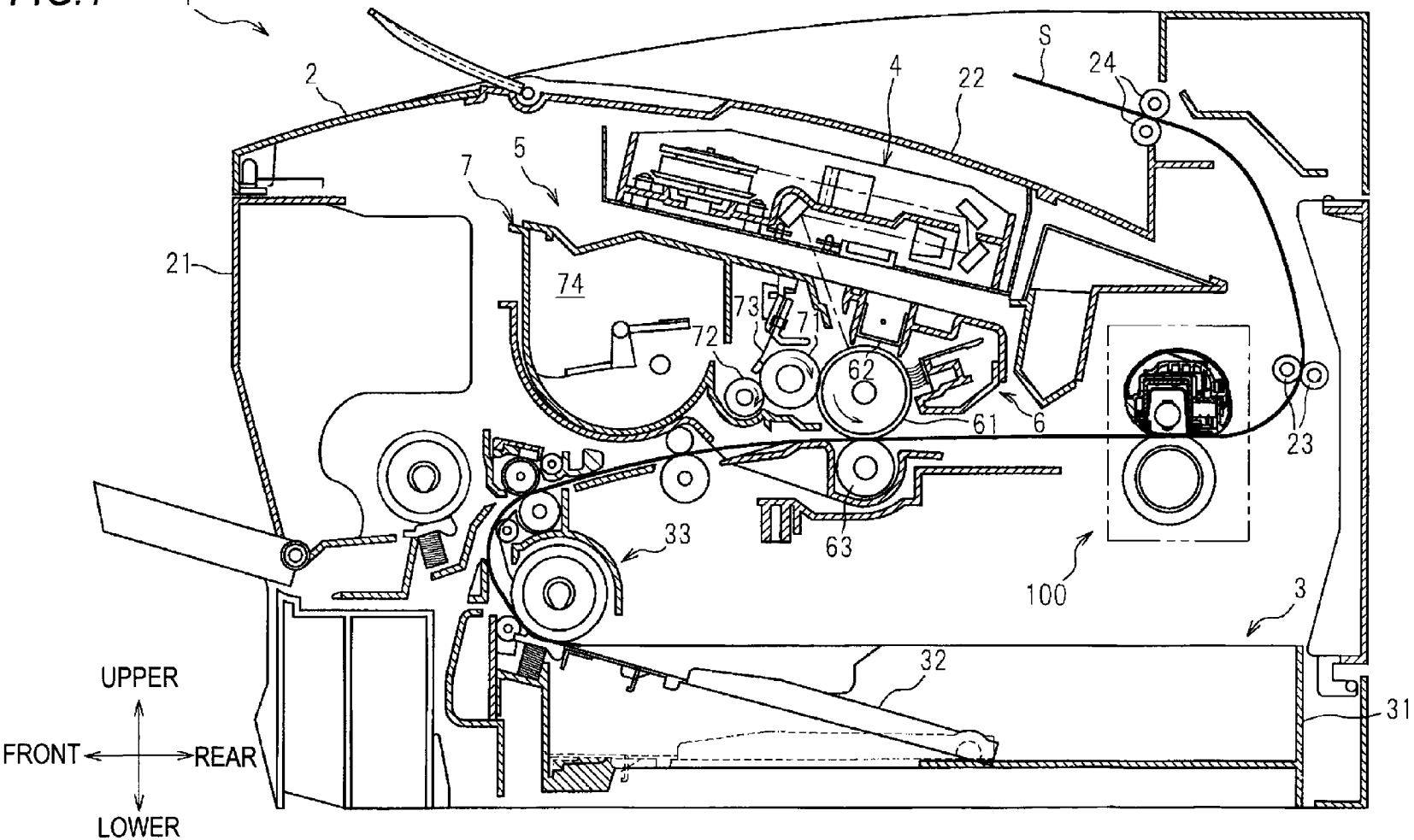
FIG. 1 is a sectional view illustrating a laser printer having a fuser unit according to an illustrative embodiment of this disclosure.

As shown in FIG. 1, the laser printer 1 mainly has, in a body housing 2, a feeder unit 3 that feeds a sheet S, which is an example of the recording sheet, an exposure device 4, a process cartridge 5 that transfers a toner image (developer image) on the sheet S and a fuser unit 100 that heat-fixes the toner image on the sheet S while moving the sheet S in the rear direction (predetermined direction).

The feeder unit 3 is provided at a lower part in the body housing 2 and mainly has a sheet feeding tray 31, a sheet pressing plate 32 and a sheet feeding mechanism 33. The sheet S accommodated in the sheet feeding tray 31 is upwardly inclined by the sheet pressing plate 32 and is fed toward the process cartridge 5 (between a photosensitive drum 61 and a transfer roller 63) by the sheet feeding mechanism 33.

The exposure device 4 is arranged at an upper part in the body housing 2 and has a laser emitting unit (not shown), a polygon mirror, a lens, a reflector and the like whose reference numerals are omitted. In the exposure device 4, a laser light (refer to the dotted-dashed line) based on image data, which is emitted from the laser emitting unit, is scanned on a surface of the photosensitive drum 61 at high speed, thereby exposing the surface of the photosensitive drum 61.

The process cartridge 5 is disposed below the exposure device 4 and is detachably mounted to the body housing 2 through an opening that is formed when a front cover 21 provided to the body housing 2 is opened. The process cartridge 5 has a drum unit 6 and a developing unit 7.

The drum unit 6 mainly has the photosensitive drum 61, a charger 62 and the transfer roller 63. Also, the developing unit 7 is detachably mounted to the drum unit 6 and mainly has a developing roller 71, a supply roller 72, a layer thickness regulation blade 73 and a toner accommodation unit 74 that accommodates toner, which is an example of the developer.

In the process cartridge 5, the surface of the photosensitive drum 61 is uniformly charged by the charger 62 and then exposed by the high-speed scanning of the laser light emitted from the exposure device 4, so that an electrostatic latent image based on image data is formed on the photosensitive drum 61. Also, the toner in the toner accommodation unit 74 is supplied to the developing roller 71 via the supply roller 72, is introduced between the developing roller 71 and the layer thickness regulation blade 73 and is carried on the developing roller 71 as a thin layer having a predetermined thickness.

The toner carried on the developing roller 71 is supplied from the developing roller 71 to the electrostatic latent image formed on the photosensitive drum 61. Thereby, the electrostatic latent image becomes visible and a toner image is thus formed on the photosensitive drum 61. Then, the sheet S is conveyed between the photosensitive drum 61 and the transfer roller 63, so that the toner image on the photosensitive drum 61 is transferred onto the sheet S.

The fuser unit 100 is arranged at the rear of the process cartridge 5. The toner image transferred on the sheet S passes through the fuser unit 100, so that the toner image is heat-fixed on the sheet S. Then, the sheet S is discharged on a sheet discharge tray 22 by conveyance rollers 23, 24.

<Detailed Configuration of Fuser Unit>

Figure 2:
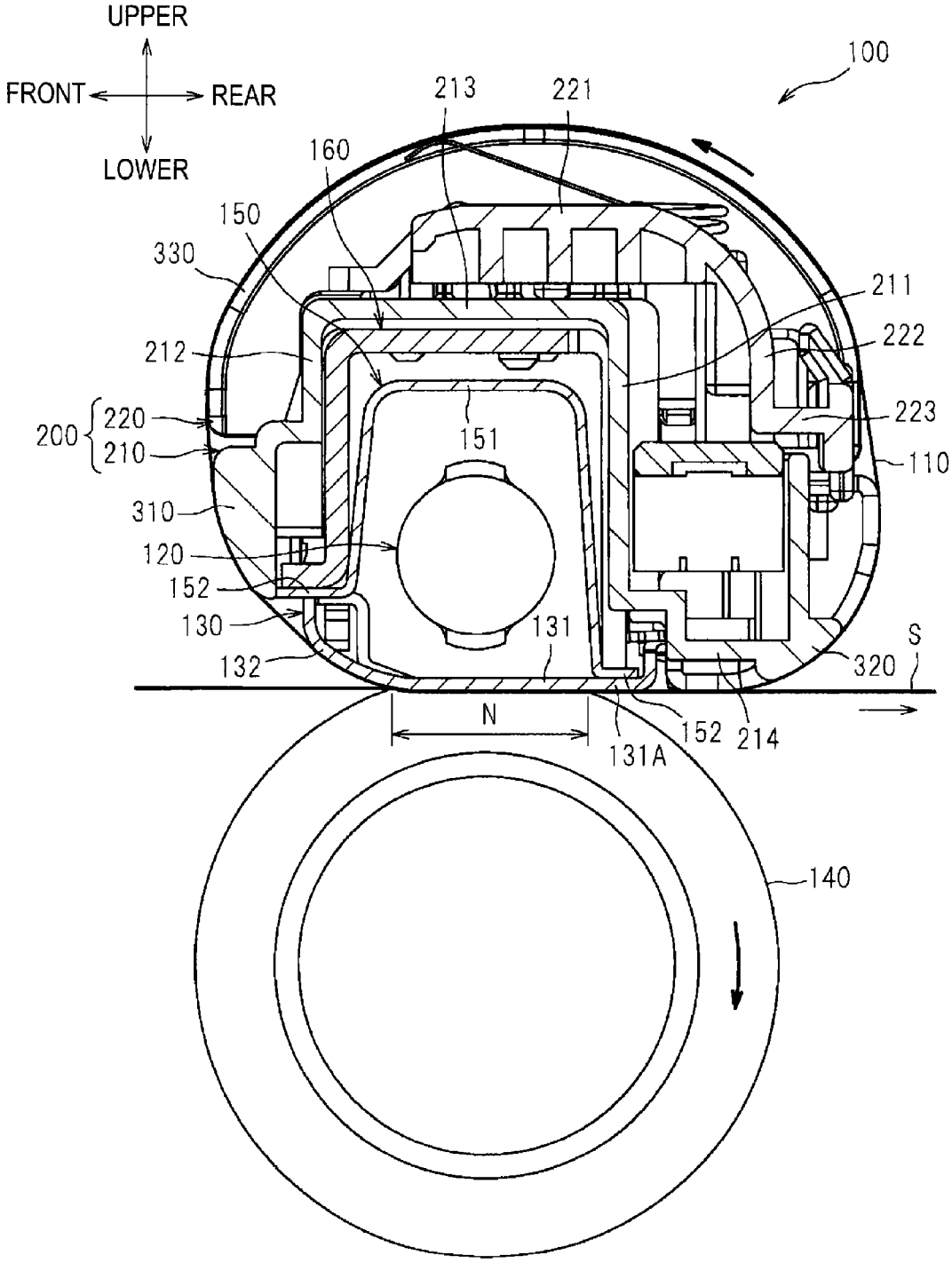
FIG. 2 is a sectional view illustrating the fuser unit.

As shown in FIG. 2, the fuser unit 100 mainly has a fixing belt 110 that is an example of the cylindrical member, a halogen lamp 120 that is an example of the heat generation member, a nip plate 130, a pressing roller 140 that is an example of the backup member, a reflection plate 150, a stay 160 and a cover member 200.

The fixing belt 110 is a stainless steel belt of an endless shape (cylindrical shape) having heat resistance and flexibility and rotation thereof is guided by a guide part (an upstream guide 310, a downstream guide 320 and upper guides 330) provided to the cover member 200.

The halogen lamp 120 is a member that generates radiation heat to thus heat the nip plate 130 and the fixing belt 110 (nip portion N), thereby heating the toner on the sheet S. The halogen lamp is arranged at an inside of the fixing belt 110 at a predetermined interval from inner surfaces of the fixing belt 110 and the nip plate 130.

The nip plate 130 is a plate-shaped member to which the radiation heat from the halogen lamp 120 is applied, and is arranged at the inside of the fixing belt 110 so that a lower surface thereof slidingly contacts an inner periphery of the fixing belt 110. In this illustrative embodiment, the nip plate 130 is formed by bending a metal plate, for example an aluminum plate and the like having thermal conductivity higher than the stay 160 made of steel, which will be described later. In the meantime, when the nip plate 130 is made of aluminum, it is possible to improve the thermal conductivity of the nip plate 130.

Figure 3:
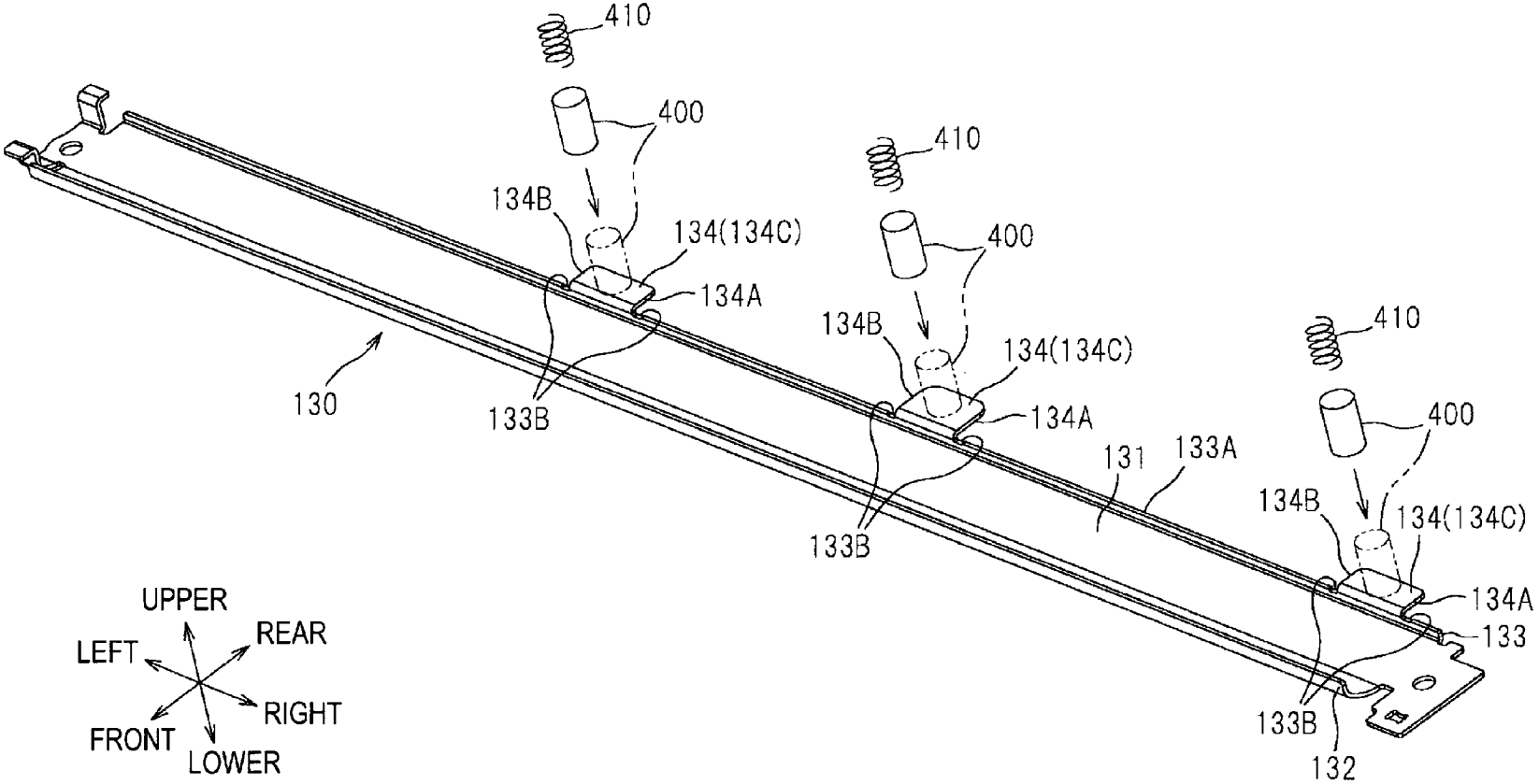
FIG. 3 is a perspective view illustrating a nip plate.

As shown in FIGS. 2 and 3, the nip plate 130 has a plate-shaped part 131, a bent part 132, a lubricant restraint part 133 and three detected parts 134.

The plate-shaped part 131 is a plate-shaped member that is orthogonal to the upper-lower direction and is long in the left-right direction, and positions the fixing belt 110 in the upper-lower direction between the pressing roller 140 and the plate-shaped part 131, so that a nip portion N is formed between the fixing belt 110 and the plate-shaped part 131. The plate-shaped part 131 is arranged below the halogen lamp 120 and is configured to transfer the heat from the halogen lamp 120 to the toner on the sheet S via the fixing belt 110.

In the meantime, an inner surface (upper surface) of the plate-shaped part 131 may be colored with black paint or provided with a heat absorption member. Thereby, it is possible to efficiently absorb the radiation heat from the halogen lamp 120.

Figure 4:
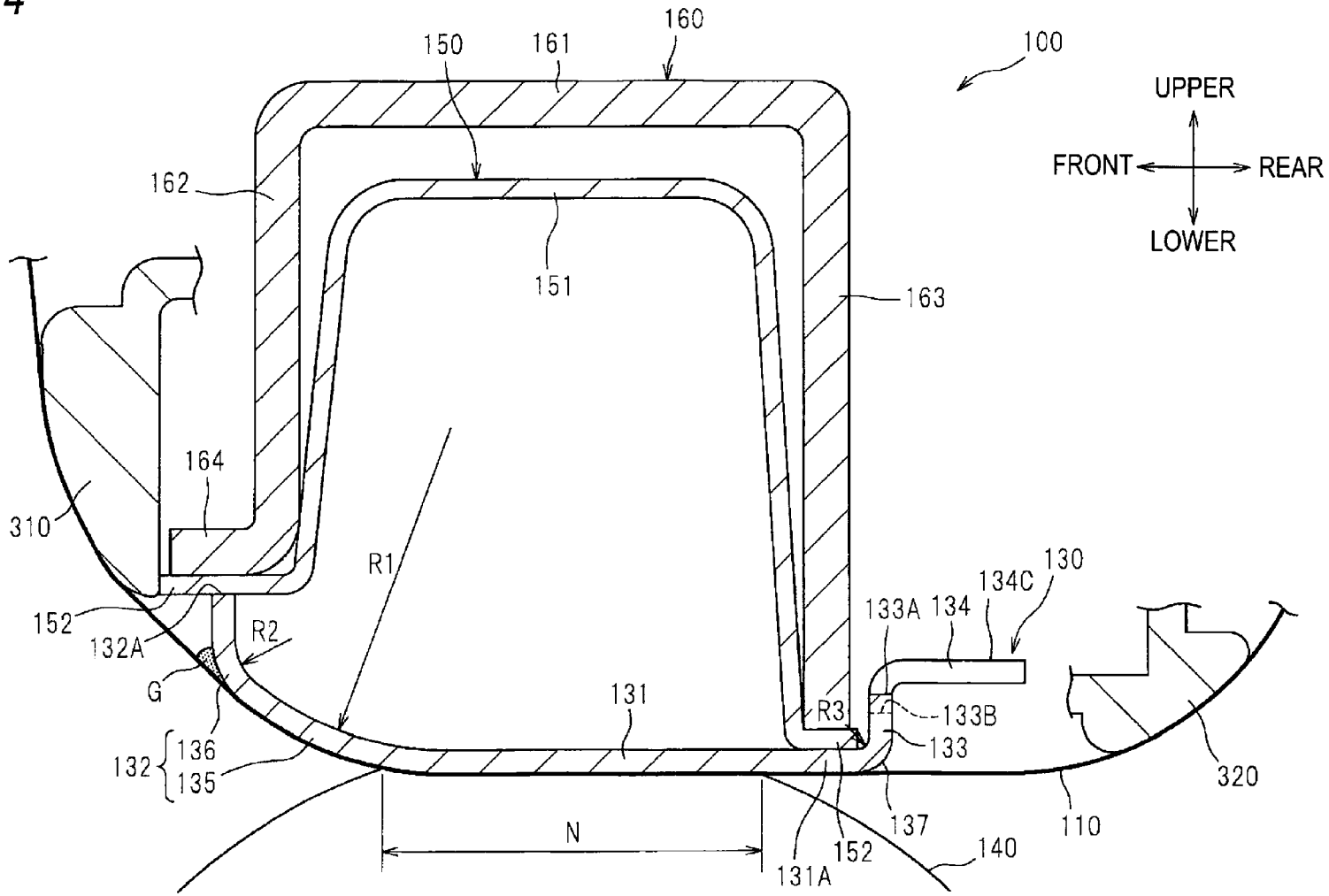
FIG. 4 illustrates a relationship between the nip plate and a stay in details.

The bent part 132 is formed so that it is substantially arc-circularly bent upward from a front end side (upstream side in the predetermined direction) of the plate-shaped part 131. Specifically, as shown in FIG. 4, the bent part 132 is bent toward a front wall 162 of the stay 160, which is an example of the upstream side wall, and an upper end 132A thereof is supported by the front wall 162 via flanges 152 of the reflection plate 150 and a flange 164 of the stay 160.

As described above, the upper end 132A of the nip plate 130 is supported by the stay 160 via the reflection plate 150. Thereby, it is possible to reduce a heat transfer area between the nip plate 130 and the reflection plate 150, compared to a configuration where a surface of the nip plate is supported by the stay via the reflection plate, for example. As the heat transfer area is reduced, an amount of heat to be transferred from the nip plate 130 to the stay 160 is reduced. Therefore, it is possible to efficiently heat the nip plate 130.

Also, the upper end 132A of the bent part 132 is supported by surfaces of the respective flanges 152, 164. Therefore, even when a position of the upper end 132A of the bent part 132 is slightly deviated in the conveyance direction due to an error, it is possible to securely support the upper end 132A by the surfaces of the respective flanges 152, 164.

Also, the bent part 132 is disposed to face the halogen lamp 120 (refer to FIG. 2). Thereby, since the bent part 132 is directly heated by the halogen lamp 120, it is possible to pre-heat the sheet S by the bent part 132 before it is introduced into the nip portion N. Hence, it is possible to improve the heat fixing ability.

Also, the bent part 132 has a first bent part 135 and a second bent part 136 that is provided at a front side of the first bent part 135.

The first bent part 135 is formed to have a first curvature radius R1 larger than a third curvature radius R3 of a third bent part 137 between the plate-shaped part 131 and the lubricant restraint part 133. Like this, the curvature radius R1 of the first bent part 135 positioned at the front side of the nip plate 130 is made to be large, so that it is possible to favorably guide the fixing belt 110 toward the nip portion N by the first bent part 135. Also, since the curvature radius R3 of the third bent part 137 positioned at the rear side is made to be small, it is possible to make the fuser unit 100 smaller in the front-rear direction (conveyance direction), compared to a configuration where the curvature radius of the third bent part is made to be the same as that of the first bent part, for example.

The second bent part 136 is formed to have a second curvature radius R2 smaller than the first curvature radius R1. Thereby, it is possible to position the upper end 132A of the bent part 132 at the rear side by the second smaller curvature radius R2, compared to a configuration where the bent part 132 is made to have one large curvature radius. Therefore, it is possible to make the fuser unit 100 smaller.

Also, the curvature radius R2 of the second bent part 136 is made to be small, so that it is possible to make an angle of a corner part formed between the second bent part 136 and the fixing belt 110 large, so that the corner part is to be large. The large corner part (between the second bent part 136 and the fixing belt 110) is provided with lubricant G. Thereby, it is possible to favorably maintain the lubricant G by the corner part.

Meanwhile, in this illustrative embodiment, both the first bent part 135 and the second bent part 136 are formed to have an arc-circular shape so that they are convex outward in the diametrical direction of the fixing belt 110. Here, if a direction of a convex of the second bent part is an opposite direction (inner side in the diametrical direction) to a direction of a convex of the first bent par, an extension part extending from an end of the second bent part toward an upstream side in the conveyance direction is formed. In that case, when the extension part is pressed by the stay, moment is applied in a direction opening the bent part, so that the nip plate is apt to be bent. However, in this illustrative embodiment, since the first bent part 135 and the second bent part 136 are formed to be convex in the same direction, an extension part extending toward an upstream side in the conveyance direction is not formed. As a result, it is possible to favorably press the nip plate 130 via the upper end 132A of the bent part 132 without bending the nip plate 130.

Also, in this illustrative embodiment, the upper end 132A of the nip plate 130 is supported by the stay 160 at the front side of the nip plate 130, as described above. However, at the rear side of the nip plate 130, a plain of the nip plate 130 is supported by the stay 160. Specifically, the plate-shaped part 131 has an extension part 131A extending rearward from the nip portion N, and an upper surface of the extension part 131A is supported by a rear wall 163 of the stay 160, which is an example of the downstream side wall, via the flanges 152 of the reflection plate 150 (which will be described later).

As described above, the upper surface of the extension part 131A is supported by the stay 160, so that it is possible to support the nip plate 130 by the stay 160 at a position adjacent to the nip portion N, compared to a structure where a rear bent part of the nip plate is formed to have a large curvature radius so as to be the same as a front bent part thereof and a rear end of the nip plate is supported by the stay. Thereby, it is possible to suppress the fuser unit 100 from being larger in the conveyance direction. Also, the extension part 131A extending rearward from the nip portion N along the conveyance direction is provided, so that it is possible to secure a larger nip width, compared to a structure where a rear portion of the plate-shaped part is bent in the vicinity of the nip portion.

As shown in FIGS. 3 and 4, the lubricant restraint part 133 is formed to extend from the rear end of the plate-shaped part 131 upward (inner side in the diametrical direction of the fixing belt 110). Specifically, the lubricant restraint part 133 is formed to extend from one end side to the other end side of the rear end of the plate-shaped part 131 in the left-right direction (axial direction). Thereby, since it is possible to effectively suppress the lubricant G, which is attached on the inner periphery of the fixing belt 110, from flowing onto the upper surface (for which the black painting and the like has been performed) of the plate-shaped part 131 by the lubricant restraint part 133, it is possible to suppress the lowering of the heating efficiency of the nip plate 130.

The three detected parts 134 are portions whose temperatures are respectively detected by temperature detection members 400 such as thermistor, thermostat and the like, and are formed to extend rearward from a part of an upper end 133A of the lubricant restraint part 133. Each of the detected parts 134 is formed to be shorter than the plate-shaped part 131 in the left-right direction (axial direction of the fixing belt 110), and all of both left and right ends 134A, 134B thereof in the left-right direction are adjacent to a space.

Specifically, an upper surface 134C (a surface facing the temperature detection member 400) of the detected part 134 is spaced from and arranged above (a direction that the upper end 133A faces) the upper end 133A of the lubricant restraint part 133. Thereby, it is possible to suppress the lubricant G from flowing onto the upper surface 134C of the detected part 134 along the upper end 133A of the lubricant restraint part 133.

Also, the lubricant restraint part 133 is formed at a right angle relative to the conveyance direction. Thereby, it is possible to prevent the lubricant G from flowing into the plate-shaped part 131, more effectively.

Also, portions of the upper end 133A of the lubricant restraint part 133, which are adjacent to the detected parts 133, are formed with notched portions 133B that are recessed downward (toward a base end side of the lubricant restraint part 133). Thereby, it is possible to favorably suppress the lubricant G from moving to the detected parts 134 by the notched portions 133B while suppressing heights (positions in the upper-lower direction) of the detected parts 134.

In the meantime, the temperature detection member 400 may be a contact type sensor that contacts the detected part 134 to detect a temperature of the detected part 134 (nip plate 130) or a non-contact type sensor that detects a temperature of the detected part 134 without contacting the detected part 134. When a contact type sensor is used as the temperature detection member 400, this disclosure becomes more effective because the lubricant G has a great influence upon detection of the temperature.

Also, in this illustrative embodiment, the temperature detection member 400 is pressed to the detected part 134 by a coil spring 410 that is an example of the pressing member.

As shown in FIG. 2, the pressing roller 140 is arranged below the nip plate 130 to form the nip portion N by sandwiching the fixing belt 110 between the nip plate 130 and the pressing roller 140. In this illustrative embodiment, one of the nip plate 130 and the pressing roller 140 is urged toward the other so as to form the nip portion N. The pressing roller 140 rotates with the fixing belt 110 sandwiched between the nip plate 130 and the pressing roller 140, so that it rotates together with the fixing belt 110, thereby conveying rearward the sheet S.

The pressing roller 140 is configured to rotate as a driving force is transferred thereto from a motor (not shown) provided in the body housing 2. As the pressing roller rotates, it rotates the fixing belt 110 by a frictional force with the fixing belt 110 (or sheet S). Thereby, the sheet S having the toner image transferred thereto is conveyed through (the nip portion N) between the pressing roller 140 and the heated fixing belt 110, so that the toner image (toner) is heat-fixed.

The reflection plate 150 is a member that reflects the radiation heat from the halogen lamp 120 toward the nip plate 130, and is arranged at a predetermined interval from the halogen lamp 120 so that the reflection plate surrounds the halogen lamp 120 at the inside of the fixing belt 110.

The reflection plate 150 is formed by bending an aluminum plate and the like having high reflectance of the infrared and far-infrared into a substantial U shape, when seen a section. More specifically, the reflection plate 150 has a reflection part 151 having a U shape and flanges 152 extending from both front and rear ends (respective ends at the nip plate 130-side) of the reflection part 151 toward the outside in the front-rear direction.

As described above, the respective flanges 152 are sandwiched between the stay 160 and the nip plate 130.

The stay 160 is a member that supports the nip plate 130 via the reflection plate 150 and thus bears load from the pressing roller 140, and is arranged to surround the halogen lamp 120 and the reflection plate 150 at the inside of the fixing belt 110. In the meantime, the load that is described here means a reactive force to the force with which the nip plate 130 urges the pressing roller 140, in a configuration where the nip plate 130 urges the pressing roller 140.

Specifically, as shown in FIG. 4, the stay 160 is formed to have a U-shaped section by an upper wall 161, a front wall 162 extending downward from a front end of the upper wall 161 and a rear wall 163 extending downward from a rear end of the upper wall 161. A lower end portion of the front wall 162 is formed with the flange 164 extending forward.

The stay 160 is formed by bending a steel plate and the like having relatively high rigidity.

As shown in FIG. 2, the cover member 200 mainly has a first cover member 210 and a second cover member 220.

The first cover member 210 has a U-shaped section, is formed to extend long in the left-right direction and is arranged to position the stay 160 between the first cover member 210 and the halogen lamp 120 and to thus cover the stay 160 from an opposite side to the halogen lamp 120. The first cover member 210 mainly has a rear side wall 211, a front side wall 212, an upper wall 213 connecting upper ends of the rear side wall 211 and the front side wall 212 and an extension wall 214 extending rearward from a lower end of the rear side wall 211.

A lower end portion of the front side wall 212 is formed with an upstream guide 310 that guides a front lower part of the fixing belt 110. Also, a rear end of the extension wall 214 is formed with a downstream guide 320 that guides a rear lower part of the fixing belt 110.

The upstream guide 310 is provided at a upstream side more than the nip portion N in the rotating direction of the fixing belt 110 and guides the fixing belt 110 toward the nip portion N. The upstream guide 310 protrudes downward (toward the nip plate 130) more than the flange 152 of the reflection plate 150.

Thereby, it is possible to suppress the fixing belt 110 from being caught at the flanges 152 of the reflection plate 150 by the upstream guide 310.

As shown in FIG. 4, the downstream guide 320 is arranged at a more rear side than the nip plate 130 and at a lower side (outer side in the diametrical direction) than the detected part 134 and guides the inner periphery of the fixing belt 110. Thereby, since it is possible to suppress the fixing belt 110 from contacting the detected part 134 more securely, it is possible to securely suppress the lubricant G from directly flowing from the inner periphery of the fixing belt 110 to the detected part 134.

As shown in FIG. 2, the second cover member 220 is formed to extend long in the left-right direction and is arranged to cover a part of the first cover member 210. The second cover member 220 mainly has an upper wall 221, a rear wall 222 extending downward from a rear end of the upper wall 221 and an extension wall 223 extending rearward from a lower end of the rear wall 222. Both left and right end portions of the upper wall 221 are formed with upper guides 330 that guide the upper part of the fixing belt 110.

In the meantime, this disclosure is not limited to the above illustrative embodiment and can be used variously, as described below.

In the above illustrative embodiment, the lubricant restraint part 133 is provided over the substantially entire region of the rear end of the plate-shaped part 131. However, this disclosure is not limited thereto. For example, the lubricant restraint part may be provided to at least a part of a downstream side end of the plate-shaped part in the conveyance direction (predetermined direction). That is, the lubricant restraint part may be formed within a range corresponding to the detected parts.

In the above illustrative embodiment, the detected part 134 is formed to extend rearward from the upper end 133A of the lubricant restraint part 133. However, this disclosure is not limited thereto. For example, the detected part may be formed to extend forward from an end of the lubricant restraint part.

In the above illustrative embodiment, the coil spring 410 has been exemplified as the pressing member. However, this disclosure is not limited thereto. For example, a plate spring, a line spring and the like may be also used.

In the above illustrative embodiment, the upper end 132A of the bent part 132 of the nip plate 130 is indirectly supported by the front wall 162 of the stay 160 via the flanges 152 of the reflection plate 150 and the flange 164 of the stay 160. However, this disclosure is not limited thereto. For example, an end of the bent part may be directly supported by an end portion of the upstream side wall of the stay.

In the above illustrative embodiment, the sheet S such as cardboard, postcard, thin paper and the like has been exemplified as the recording sheet. However, this disclosure is not limited thereto. For example, an OHP sheet may be also used.

In the above illustrative embodiment, the halogen lamp 120 has been exemplified as the heat generation member. However, this disclosure is not limited thereto. For example, a heat generation resistance member may be also used.

In the above illustrative embodiment, the pressing roller 140 has been exemplified as the backup member. However, this disclosure is not limited thereto. For example, a belt-type pressing member may be also used.

What is claimed is:

1. A fuser unit, which heat-fixes a developer image on a recording sheet while moving the recording sheet in a predetermined direction, the fuser unit comprising:

a cylindrical member having flexibility;

a heat generation member that is arranged at an inside of the cylindrical member;

a nip plate that is arranged at the inside of the cylindrical member and to which radiation heat from the heat generation member is applied;

a backup member that forms a nip portion by sandwiching the cylindrical member between the nip plate and the backup member;

a lubricant that is provided to an inner periphery of the cylindrical member; and a temperature detection member that detects a temperature of the nip plate, wherein the nip plate has:

a plate-shaped part that forms the nip portion;

a lubricant restraint part that is formed on at least a part of a downstream side end of the plate-shaped part in the predetermined direction and that extends toward an inner side in a diametrical direction of the cylindrical member; and a detected part that extends from an end of the lubricant restraint part toward the predetermined direction, wherein a temperature of detected part is detected by the temperature detection member, wherein the detected part is formed to be shorter than the plate-shaped part in an axial direction of the cylindrical member, and both ends of the detected part in the axial direction are adjacent to a space, and wherein a bent part, which has a curvature radius larger than that of a bent part between the plate-shaped part and the lubricant restraint part, is provided at an upstream side of the plate-shaped part in the predetermined direction.

2. The fuser unit according to claim 1, wherein the lubricant restraint part is formed to extend from one end side to the other end side of the plate-shaped part in the axial direction, and wherein a surface of the detected part facing the temperature detection member is spaced from the end of the lubricant restraint part in a direction that the end of the lubricant restraint part faces.

3. The fuser unit according to claim 2, wherein a portion of the end of the lubricant restraint part, which is adjacent to the detected part, is formed with a notched portion that is recessed toward a base end side of the lubricant restraint part.

4. The fuser unit according to claim 1, wherein the lubricant restraint part is formed at a right angle relative to the predetermined direction.

5. The fuser unit according to claim 1, further comprising a downstream guide that is arranged at a downstream side more than the nip plate and at an outer side more than the detected part in the diametrical direction and that guides the inner periphery of the cylindrical member.

6. The fuser unit according to claim 1, wherein the nip plate is made of metal.

7. The fuser unit according to claim 1, wherein the temperature detection member contacts the detected part.

8. The fuser unit according to claim 7, further comprising a pressing member that presses the temperature detection member toward the detected part.

9. A fuser unit, which heat-fixes a developer image on a recording sheet while moving the recording sheet in a predetermined direction, the fuser unit comprising:

a cylindrical member having flexibility;

a heat generation member that is arranged at an inside of the cylindrical member;

a nip plate that is arranged at the inside of the cylindrical member and to which radiation heat from the heat generation member is applied;

a stay having a U-shaped section that supports the nip plate while surrounding the heat generation member; and a backup member that forms a nip portion by sandwiching the cylindrical member between the nip plate and the backup member, wherein an upstream side of the nip plate in the predetermined direction is formed with a bent part that is bent toward an upstream side wall of the stay, wherein an end of the bent part is supported by the upstream side wall, and wherein the bent part has a first bent part that is formed to have a first curvature radius and a second bent part that is formed to have a second curvature radius smaller than the first curvature radius and that is provided to an upstream side portion of the first bent part.

10. The fuser unit according to claim 9, wherein the bent part faces the heat generation member.

11. The fuser unit according to claim 9, wherein a lubricant is provided between the second bent part and the cylindrical member.

12. The fuser unit according to claim 9, wherein an end portion of the upstream side wall of the stay is formed with a flange extending toward the upstream side, and wherein the end of the bent part of the nip plate is supported by a face of the flange.

13. The fuser unit according to claim 9, further comprising a reflection plate having a U-shaped section that is arranged at the inside of the cylindrical member while surrounding the heat generation member and that reflects the radiation heat from the heat generation member toward the nip plate, wherein each end of the reflection plate facing the nip plate is formed with a flange extending outward in the predetermined direction, and wherein the flanges of the reflection plate are sandwiched between the stay and the nip plate.

14. The fuser unit according to claim 13, further comprising an upstream guide that is provided at an upstream side of the nip portion in a rotating direction of the cylindrical member and that guides the cylindrical member toward the nip portion, wherein the upstream guide protrudes toward the nip plate more than the flanges of the reflection plate.

15. The fuser unit according to claim 9, wherein the nip plate has an extension part that extends downstream in the predetermined direction from the nip portion, and wherein a plain of the extension part is supported by a downstream side wall of the stay.

16. A fuser unit, which heat-fixes a developer image on a recording sheet while moving the recording sheet in a predetermined direction, the fuser unit comprising:

a cylindrical member having flexibility;

a heat generation member that is arranged at an inside of the cylindrical member;

a nip plate that is arranged at the inside of the cylindrical member and to which radiation heat from the heat generation member is applied;

a stay having a U-shaped section that supports the nip plate while surrounding the heat generation member; and a backup member that forms a nip portion by sandwiching the cylindrical member between the nip plate and the backup member, wherein an upstream side of the nip plate in the predetermined direction is formed with a bent part that is bent toward an upstream side wall of the stay, wherein an end of the bent part is supported by the upstream side wall, wherein an end portion of the upstream side wall of the stay is formed with a flange extending toward the upstream side, and wherein the end of the bent part of the nip plate is supported by a face of the flange.

17. The fuser unit according to claim 16, wherein the bent part faces the heat generation member.

18. The fuser unit according to claim 16, wherein the bent part has a first bent part that is formed to have a first curvature radius and a second bent part that is formed to have a second curvature radius smaller than the first curvature radius and that is provided to an upstream side portion of the first bent part.

19. The fuser unit according to claim 16, wherein a lubricant is provided between the second bent part and the cylindrical member.

20. The fuser unit according to claim 16, further comprising a reflection plate having a U-shaped section that is arranged at the inside of the cylindrical member while surrounding the heat generation member and that reflects the radiation heat from the heat generation member toward the nip plate, wherein each end of the reflection plate facing the nip plate is formed with a flange extending outward in the predetermined direction, and wherein the flanges of the reflection plate are sandwiched between the stay and the nip plate.

21. The fuser unit according to claim 20, further comprising an upstream guide that is provided at an upstream side of the nip portion in a rotating direction of the cylindrical member and that guides the cylindrical member toward the nip portion, wherein the upstream guide protrudes toward the nip plate more than the flanges of the reflection plate.

22. The fuser unit according to claim 16, wherein the nip plate has an extension part that extends downstream in the predetermined direction from the nip portion, and wherein a plain of the extension part is supported by a downstream side wall of the stay.

* * * * *